US007040522B2

(12) United States Patent
Osuga et al.

(10) Patent No.: US 7,040,522 B2
(45) Date of Patent: May 9, 2006

(54) NAIL MAGAZINE OF NAILING MACHINE

(75) Inventors: Satoshi Osuga, Tokyo (JP); Mitsugu Takezaki, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 11/049,699

(22) Filed: Feb. 4, 2005

(65) Prior Publication Data

US 2005/0127128 A1 Jun. 16, 2005

Related U.S. Application Data

(62) Division of application No. 10/490,624, filed as application No. PCT/JP02/09979 on Sep. 26, 2002, now Pat. No. 6,902,092.

(30) Foreign Application Priority Data

Sep. 27, 2001 (JP) ..... P. 2001-296053
Sep. 27, 2001 (JP) ..... P. 2001-296256
Sep. 27, 2001 (JP) ..... P. 2001-297827

(51) Int. Cl.
*B25C 1/04* (2006.01)

(52) U.S. Cl. ..... 227/119; 227/120; 227/136; 227/138

(58) Field of Classification Search ..... 227/109, 227/119, 120, 136, 138, 135, 8
See application file for complete search history.

(56) References Cited

U.S. PATENT DOCUMENTS 3,266,697 A * 8/1966 Fiedler ..... 227/120
3,437,249 A 4/1969 Baum ..... 227/120
4,558,811 A 12/1985 Klaus ..... 227/116
4,784,306 A 11/1988 Baum ..... 227/113
5,038,993 A * 8/1991 Schafer et al. ..... 227/120
5,273,200 A 12/1993 Hoefler ..... 227/136
5,626,274 A 5/1997 Shkolnikov et al. ..... 227/109
6,499,642 B1 * 12/2002 Amada ..... 227/119
6,598,777 B1 7/2003 Osuga et al. ..... 227/136
6,626,345 B1 9/2003 Amada ..... 227/120
6,655,572 B1 12/2003 Amada ..... 227/109
6,902,092 B1 * 6/2005 Osuga et al. ..... 227/119

FOREIGN PATENT DOCUMENTS

JP 52-96474 U 7/1977
JP 2001-54879 A 2/2001

* cited by examiner

*Primary Examiner*—Scott A. Smith
(74) *Attorney, Agent, or Firm*—Morgan Lewis & Bockius LLP

(57) ABSTRACT

A nail feeding mechanism is provided with a front feed claw (9) and a rear feed claw (10). The rear feed claw (10) is provided with a contact portion (10*b*) on a front side of a claw portion (10*a*). A face of the contact portion (10*b*) to be brought into contact with connected nails is wider than a gap between nails in a width thereof and cannot enter between nails. When the front feed claw (9) is moved rearward and catches a final nail (TN1) of a first row, the contact portion (10*b*) and the claw portion (10*a*) move into a nail path, the contact portion (10*b*) enters between the final nail (TN1) of the first row and a front nail (FN2) of a second row and the claw portion (10*a*) enters a rear side of the front nail (FN2) of the second row. After feeding nails, the feed claw is moved rearward, the contact portion (10*b*) and the claw portion (10*a*) ride over side faces of the second row of connected nails (N2) to return to escaping positions and the feed claw (9) is engaged with the front nail (FN2) of the second row to continue nail feeding.

1 Claim, 12 Drawing Sheets

PRIOR ART

NAIL MAGAZINE OF NAILING MACHINE

This is a divisional application of prior application Ser. No. 10/490,624, filed on Aug. 3, 2004, now U.S. Pat. No. 6,902,092 which is a 371 of PCT/JP02/099, filed Sep. 26, 2002, which is incorporated by reference herein in its entirety.

TECHNICAL FIELD

The present invention relates to a nail magazine of a nailing machine, particularly relates to a series charging type nail magazine capable of charging a plurality of sheets of connected nails.

BACKGROUND ART

In a nail magazine of a nailing machine, using connected nails referred to as stick nails or sheet nails or the like in which a number of nails are connected by a strip of hard paper or the like, a series charging type nail magazine for increasing a number of charged containing nails by enabling to overlappingly charge a plurality of sheets of connected nails is proposed. A nail magazine of this kind is constituted such that a plurality of sheets of connected nails which are overlappingly charged are pressed to a nail guide face pressure plate and nails are fed by a feed claw arranged on a side of the nail guide face.

For example, the nail magazine of two sheets containing type is formed such that when a first row (a first sheet) of connected nails are fed by the feed claw, a second row (a second sheet) of connected nails cannot be moved forward by being brought into contact with a front wall face of a nail containing chamber and only the first row of connected nails disposed at a nail path to a nose are fed. Nail feeding is carried out by a nail feeding air cylinder of a spring offset type, similar to a general nail magazine, a piston is moved rearward by pressurized air supplied from a blowback chamber of a nailing machine and the piston is moved forward by exhausting pressurized air. When the piston is moved forward, the feed claw of a ratchet type attached to a front end of a piston rod is engaged with the first row of connected nails to feed forward, thereby a front nail is fed into the nose. When a tail of the first row of connected nails is moved forward from a front of the second row of connected nails and a space at a position of the first row is vacated, the second row of connected nails are moved to the position of the first row by being pressed by the pressure plate and brought into contact with the tail of the first row of connected nails to continuously supply to the nose.

According to the series charging type nail magazine of the related art, the feed claw is designed to carry out nail feeding by being engaged with only connected nails at the position of the first row. However, when a rearmost nail of the first row passes a position of a front of the second row and the second row of connected nails are moved to the position of the first row, there is a case in which the feed claw is caught by both of the final nail of the first row and the front nail of the second row. The nail path reaching the nose of the striker is provided with a cross width of a single piece of nail and therefore, two pieces of nails which are aligned crossly cannot simultaneously enter the nail path and when the above-described state is produced, nail clogging is brought about to stop nail feeding and connected nails are obliged to recharge.

Further, in the case of the series charging type nail magazine for pressing connected nails constituted by overlappingly containing a plurality of sheets of connected nails to the nail guide face by the pressure plate and feeding nails by the feed claw on the side of the nail guide face, there poses a problem that when a number of sheets of connected nails at inside of the nail magazine becomes single and the connected nails are consumed to some degree, in the case in which a second sheet of connected nails are inserted from a charge port at a rear portion of the nail magazine, also the connected nails enter the position of the first row by being pressed by the pressure plate and butted to the tail of the first row of connected nails and cannot be charged to the side of the first row.

Further, there is also proposed a series type nail magazine constituted by mounting heads of a succeeding row of connected nails above heads of the first row of connected nails to contain at a different stage. According to the series mounting type nail magazine, connected nails at inside of a nail magazine are pressed to a side of a first row by a pressure plate.

When the first row of connected nails are fed by a feed claw in accordance with nail striking operation and a final nail is moved frontward from a front nail of a succeeding row, the succeeding row of nails are pressed by the pressure plate to move to the position of the first row. At this occasion, in order to enable to move succeeding connected nails held at a position higher than that of the first row of connected nails to a slightly lower predetermined position and addingly charge new connected nails contiguous thereto, a ceiling face of a front portion of a guide groove supporting nail heads of the first row of connected nails are inclined downwardly relative to a nail feeding direction and when connected nails moved to the first row are fed frontward by the feed claw, and the nail heads are brought into contact with the ceiling face to move downward forcibly. In this case, in the case of sheet type connected nails N in an inclined shape in which heights of nails are successively lowered to a front side as shown by. FIG. 12, when a feed claw 221 moving forward by an angle the same as an inclined angle of the connected nails N presses the connected nails N in a front skewed direction, a vector of the feed claw 221 and an axis of the nail are not orthogonal to each other and therefore, a slippage is produced between the feed claw 221 and the nail and the connected nails N are pressed up in an upward direction. Thereby, the nail head is pressed to a lower inclined face 222 of the ceiling face of the guide groove and cannot smoothly be moved forward and nail feeding may be stopped. Further, by stopping to feed the nail, there is also a possibility that a driver 223 idly strikes a struck member to damage the member and by idle striking, there is concern that an excessive load is applied to the driver or a bumper (impact damping member) to destruct the member. Further, since the nail head portion is pressed to the lower inclined face 222 of the ceiling face of the guide and the front nail is fed by the feed claw 221, at a connecting strip comprising paper, an adhering layer and the like having a low nail holding force, there is also a possibility that the front nail is detached from the connecting member before being struck to thereby cause a clogging.

It is an object of the invention to resolve instability in nail feeding in a series charging type nail magazine.

Further, it is an object of the invention to enable to charge connected nails to predetermined positions firmly and easily.

SUMMARY OF THE INVENTION

The invention is proposed to achieve the above-described object, and provides a nail magazine of a nailing machine characterized in a nail magazine of a nailing machine for overlappingly containing a plurality of sheets of sheet type connected nails in parallel and continuously supplying the plurality of sheet type connected nails to a nose by a feed claw, providing a second feed claw on a rear side of the feed claw, and providing a contact portion brought into contact with a first row of the connected nails on a front side of the second feed claw, wherein when the first row of connected nails passes the contact portion, the second feed claw is engaged with the connected nails of a successively row.

Further, the invention provides a nail magazine of a nailing machine characterized in a nail magazine of a nailing machine comprising a nail containing chamber for overlappingly containing a plurality of sheets of sheet type connected nails in parallel, a nail feeding air cylinder for feeding a first row of the connected nails to a nose by a feed claw, and a pressing member for pressing the connected nails-in the nail magazine in a direction of the first row, wherein a front portion of a guide groove for supporting heads of the first row of connected nails is formed with an inclined face rising to a front side and a high position support face, and the first row of connected nails fed by the feed claw are pulled up to a position higher than positions of a second row of connected nails and supported at a different stage.

Further, the invention provides a nail magazine of a nailing machine characterized in a nail magazine of a nailing machine for overlappingly containing a plurality of sheets of sheet type connected nails in parallel including a hook type member slidable frontward and rearward along an inner wall face opposed to a nail guide face wherein the connected nails are charged into the nail magazine by being guided by the hook type member.

BRIEF DESCRIPTION OF THE DRAWINGS

FIG. 8A is a view taken along a line A—A of FIG. 8C, FIG. 8B is a view taken along a line B—B of FIG. 8C and FIG. 8C is a side view of the nail magazine, FIG. 9A is a view taken along a line A—A of FIG. 9C, FIG. 9B is a view taken along a line B—B of FIG. 9C and FIG. 9C is a side view of nail magazine, FIG. 9A is a view taken along a line A—A of FIG. 9C, FIG. 9B is a view taken along a line B—B of FIG. 9C and FIG. 9C is a side view of the nail magazine, FIG. 10A is a view taken along a line A—A of FIG. 10C, FIG. 10B is a view taken along a line B—B of FIG. 10C and FIG. 10C is a side view of the nail magazine, FIG. 11A is a view taken-along a line A—A of FIG. 11C, FIG. 11B is a view taken along a line B—B of FIG. 11C and FIG. 11C is a side view of the nail magazine.

DESCRIPTION OF THE PREFERRED EMBODIMENTS

A detailed description will be given of a mode for carrying out the invention in reference to the drawings as follows.

First Embodiment

Figure 1:
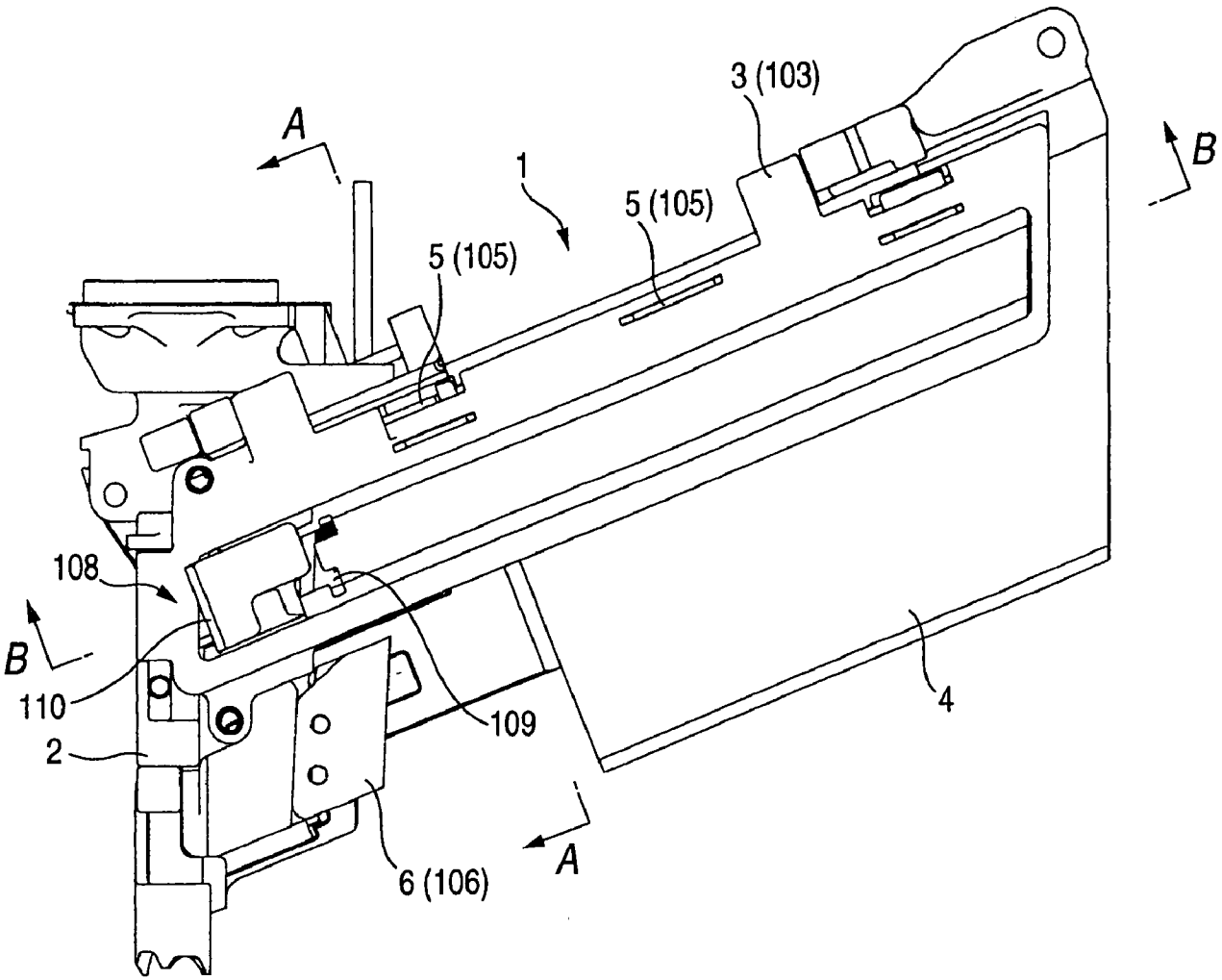
FIG. 1 is a side view of a nose and a nail magazine of a nailing machine according to the invention.
Figure 2:
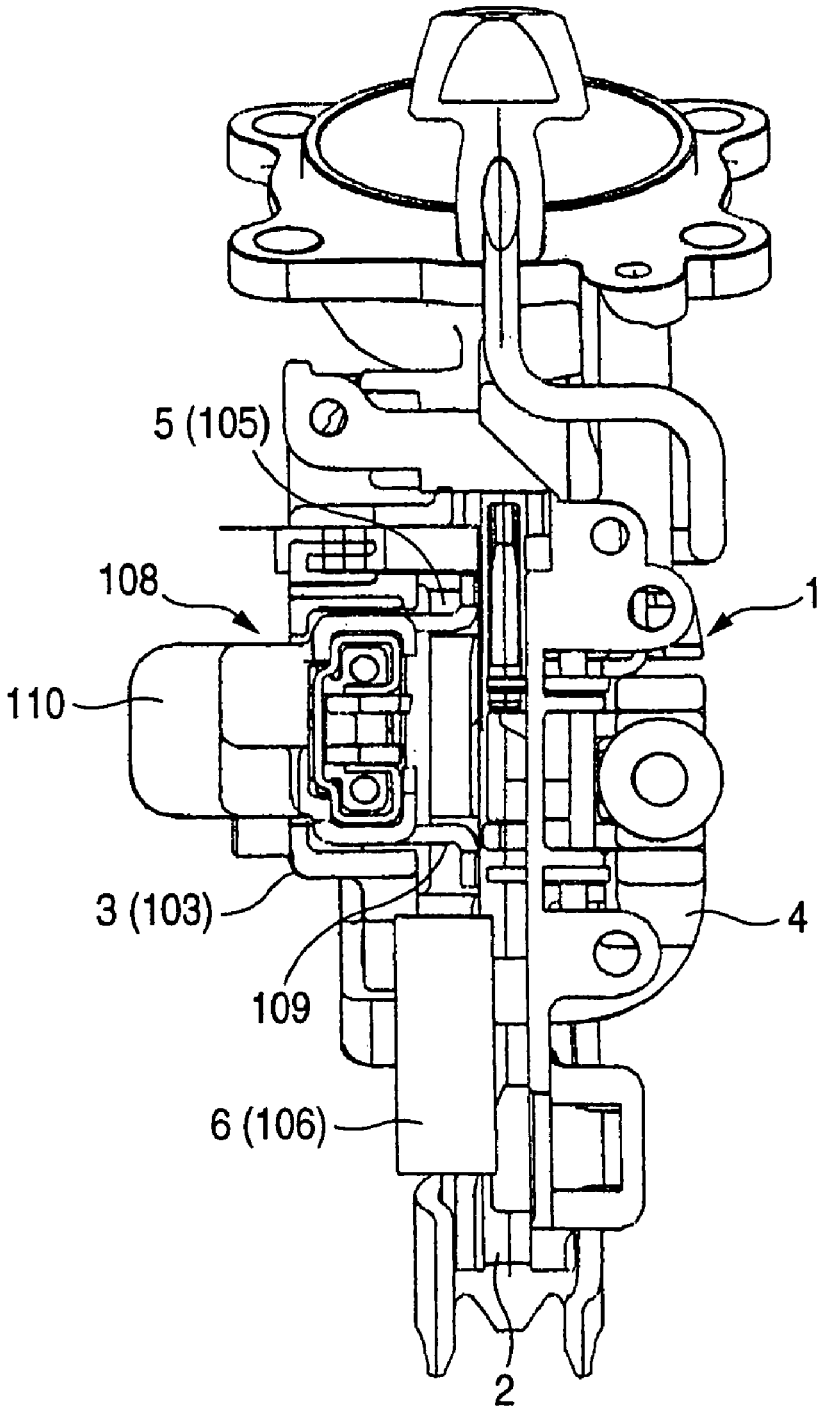
FIG. 2 is a view taken along a line A—A of FIG. 1.
Figure 3:
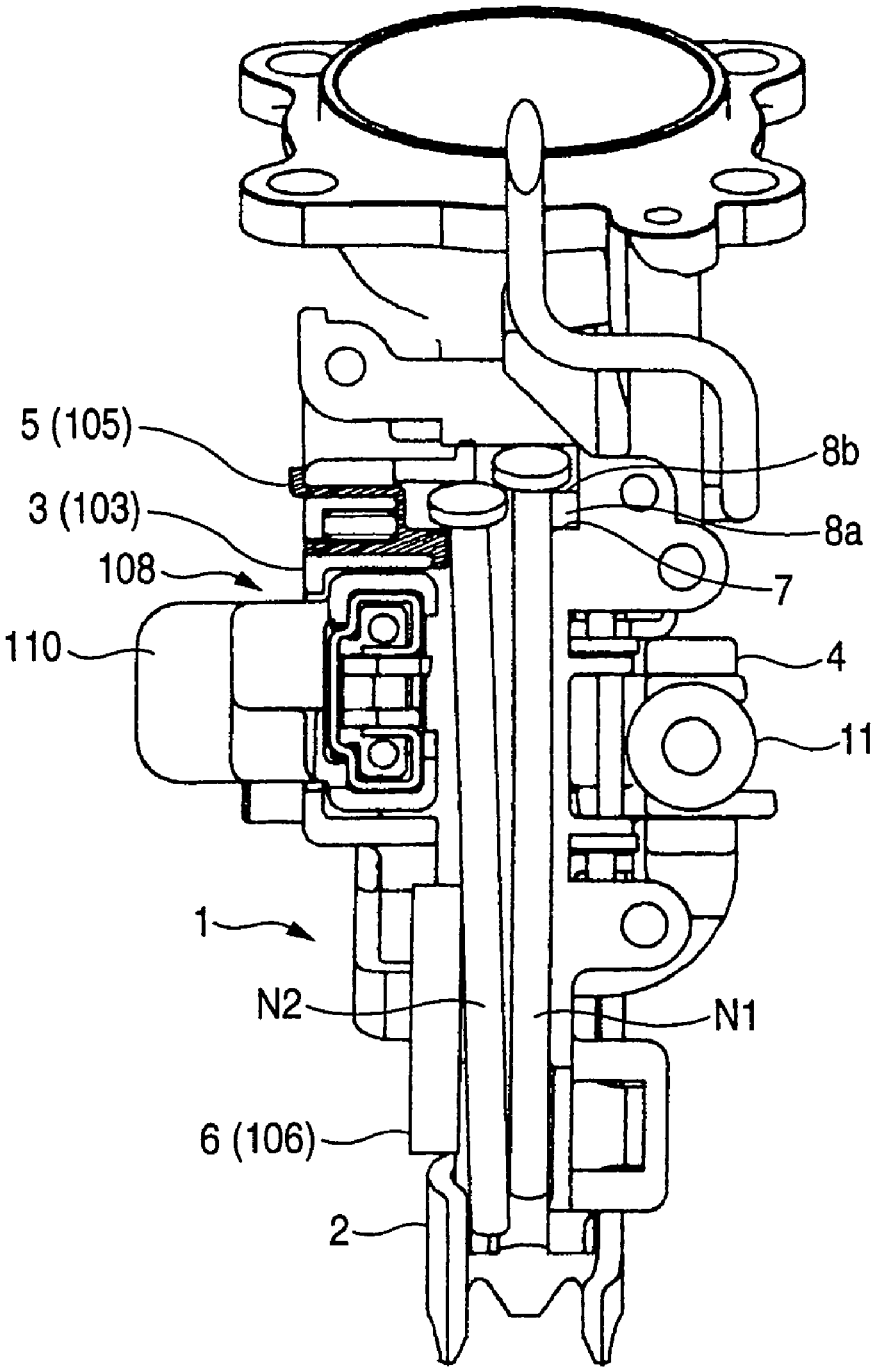
FIG. 3 is a view taken along the line A—A of FIG. 1 showing a state of charging connected nails to the nail magazine.

FIG. 1 shows a nail magazine 1 and a nose 2 of a pneumatic nailing machine and the nose 2 is coupled to a front end of a cylinder housing (not illustrated) of a nailing machine main body by a bolt. The nail magazine 1 is coupled to a back face of the nose 2 and inclined in a front downward direction in compliance with a shape of sheet type connected nails, the connected nails charged into the nail magazine 1 are fed frontward by a feed claw (not illustrated) and a front nail is supplied into the nose 2. FIG. 2 and FIG. 3 are views taken along a line A—A of FIG. 1, a nail containing chamber of the nail magazine 1 can contain two sheets of connected nails in parallel, a center line of a first row (a first sheet) of connected nails. A1 on the right and a center line of the nose 2 coincide with each other in FIG. 3, and a second row (a second sheet) of connected nails N2 are charged to the left. The nail magazine 1 is bonded with a left cover 3 and a right cover 4 which are molded dividedly and as shown by FIG. 3, a pressure plate 5 of a spring prepressurizing type and a foot front holding spring 6 press left side faces of connected nails at inside of the nail containing chamber to press to a right wall. When the first row of connected nails N1 are fed by the feed claw of a nail feeding mechanism, a tail nail is moved forward from a front end of the second connected nails N2 and a space of the first row is vacated, the second row of connected nails N2 are pressed by the pressure plate 5 to move to the position of the first row and the second row of connected nails N2 are brought into contact with a tail of the first row of connected nails N1 to thereby continuously supply the two sheets of connected nails to the nose.

Figure 4:
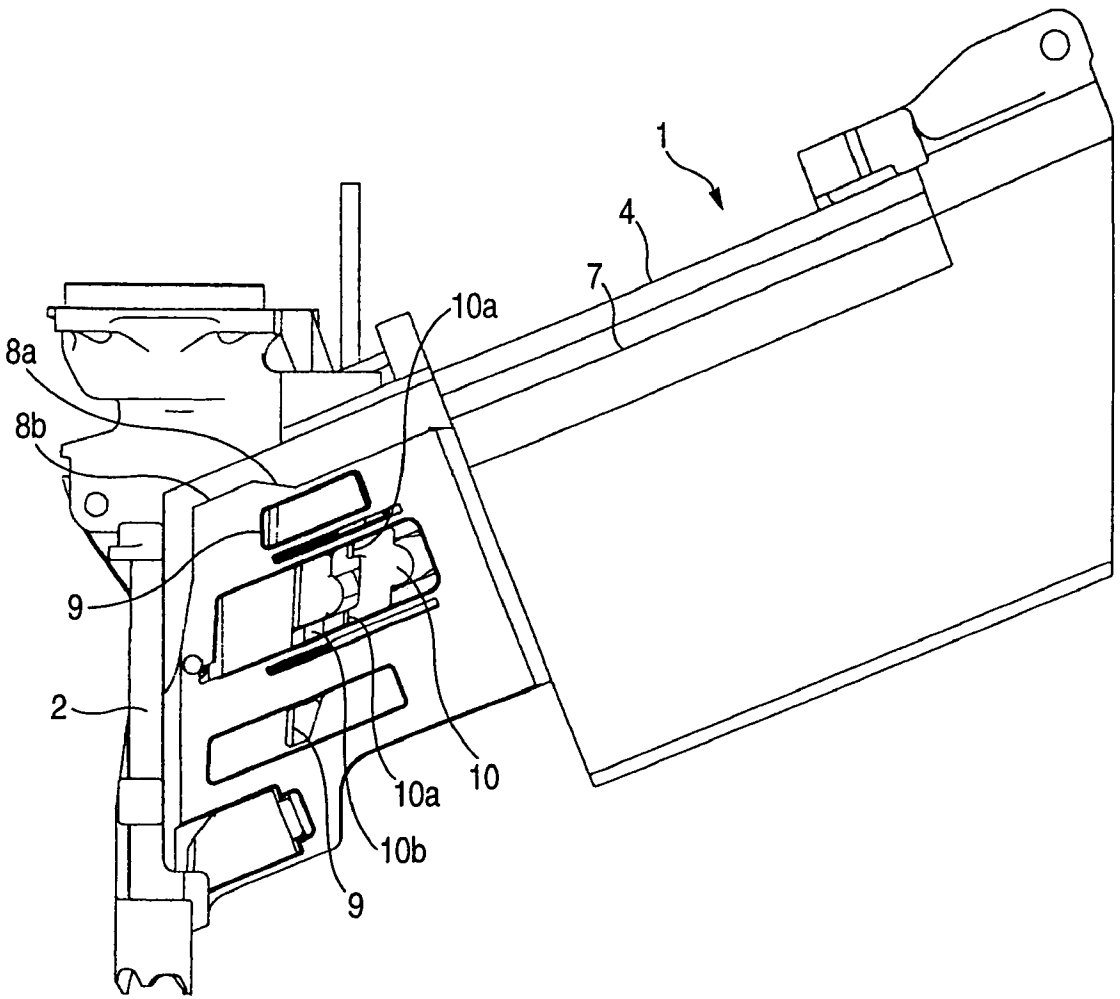
FIG. 4 is a disassembled side view of a nailing machine according to a first embodiment.

An upper portion of a right wall face of the nail containing chamber is formed with a guide groove 7 for supporting the first row of connected nails and heads of the connected nails N1 are hung on a horizontal bottom face of the guide groove 7 to support. A position of the second row is lower than a position of the first row at ceiling faces thereof and heads of the second row of connected nails N2 are hung on the pressure plate 5 to support. As shown by FIG. 3 and FIG. 4, the horizontal bottom face of the guide groove 7 is continuous to a high position support face 8*b* via an inclined face 8*a* rising at a vicinity of the nose 2 and the first row of connected nails N1 rise along the inclined face 8*a* to mount on the high position support face 8*b* and are supplied to the nose 2. Therefore, the heads of the first row of connected nails N1 are moved to a position higher than the heads of the second row of connected nails N2, the first row of connected nails N1 and the second row of connected nails N2 are contained at different stages to thereby downsize a cross width dimension of the nail magazine 1. Further, as described above, when the feed claw presses the connected nails frontward, a force of pressing up the connected nails in the upward direction is operated and therefore, movement of connected nails in rising along the inclined face 8*a* is smooth and nail feeding is not stopped.

Figure 5:
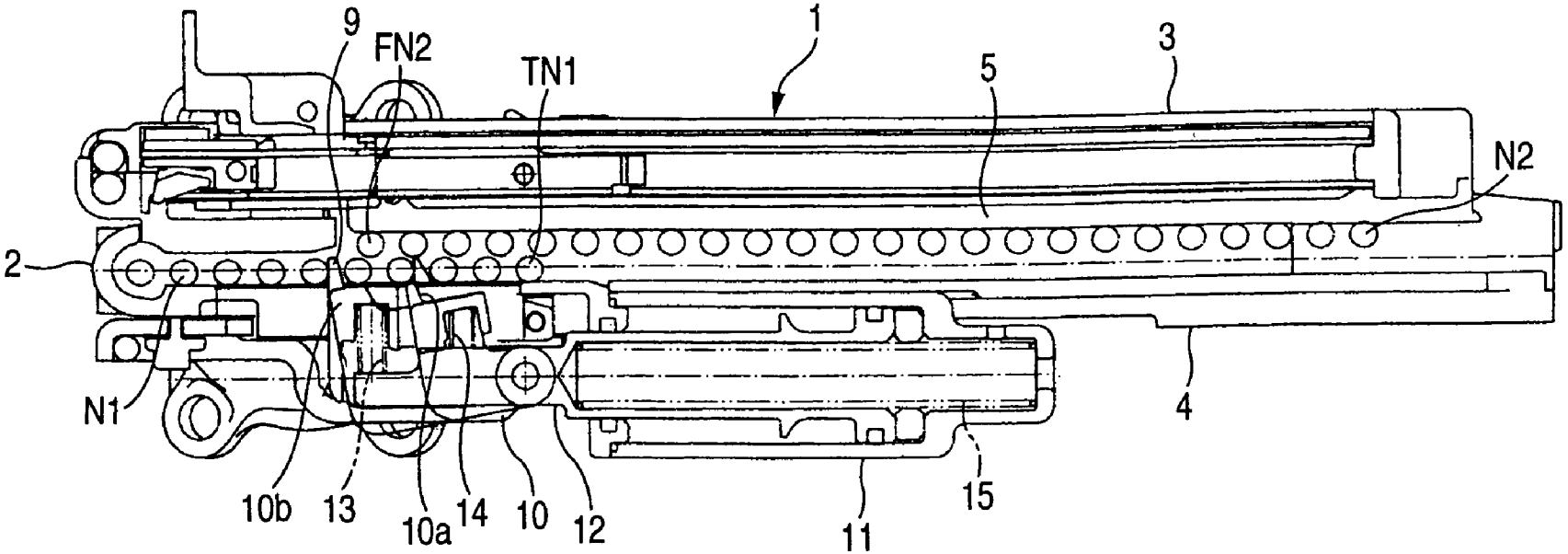
FIG. 5 is a view taken along a line B—B of FIG. 1.

FIG. 4 shows an inner wall face of the right cover 4 by removing the left cover 3 and at a front portion thereof, a feed claw portion of a nail feeding mechanism is exposed. The nail feeding mechanism is provided with two feed claws of a front feed claw 9 and a rear feed claw 10 and as shown by FIG. 5, the two feed claws 9, 10 are axially attached to a piston rod 12 of a spring offset type nail feeding air cylinder 11 and urged to be brought into elastic contact with side faces of connected nails respectively by compression coil springs 13, 14. Although the drawing shows a state of moving the feed claws 9, 10 rearward by supplying pressurized air to the nail feeding air cylinder 11, in an initial state in which pressurized air is not supplied, the piston rod 12 and the feed claws 9, 10 are moved forward to frontmost positions by a compression coil spring 15 at inside of the air cylinder 11.

The front feed claw 9 is disposed at a position slightly frontward from a front of the second row of connected nails N2 at the moved-back position in FIG. 5. As shown by FIG. 4 and FIG. 5, the rear feed claw 10 is integrally formed with a claw portion 10*a* at a middle portion and a contact portion 10*b* extended frontward therefrom and the contact portion 10*b* is disposed right after the front feed claw 9. Heights of ridges of the claw portion 10*a* and the contact portion 10*b* are substantially the same and a face of the contact portion 10*b* in contact with connected nails is formed to be wider than an interval between nails of connected nails in a width thereof such that the contact face cannot enter between nails.

Successively, operation of the nail feeding mechanism will be explained. As shown by FIG. 5, in a state in which the first row of connected nails N1 and the second row of connected nails N2 are overlappingly charged, the contact portion 10*b* of the rear feed claw 10 is brought into contact with the side faces of the first row of connected nails N1 and the rear feed claw 10 is pressed down in an outer side direction and the claw portion 10*a* is escaped to a position at which the claw portion 10*a* is not engaged with the first row of connected nails N1.

Figure 6:
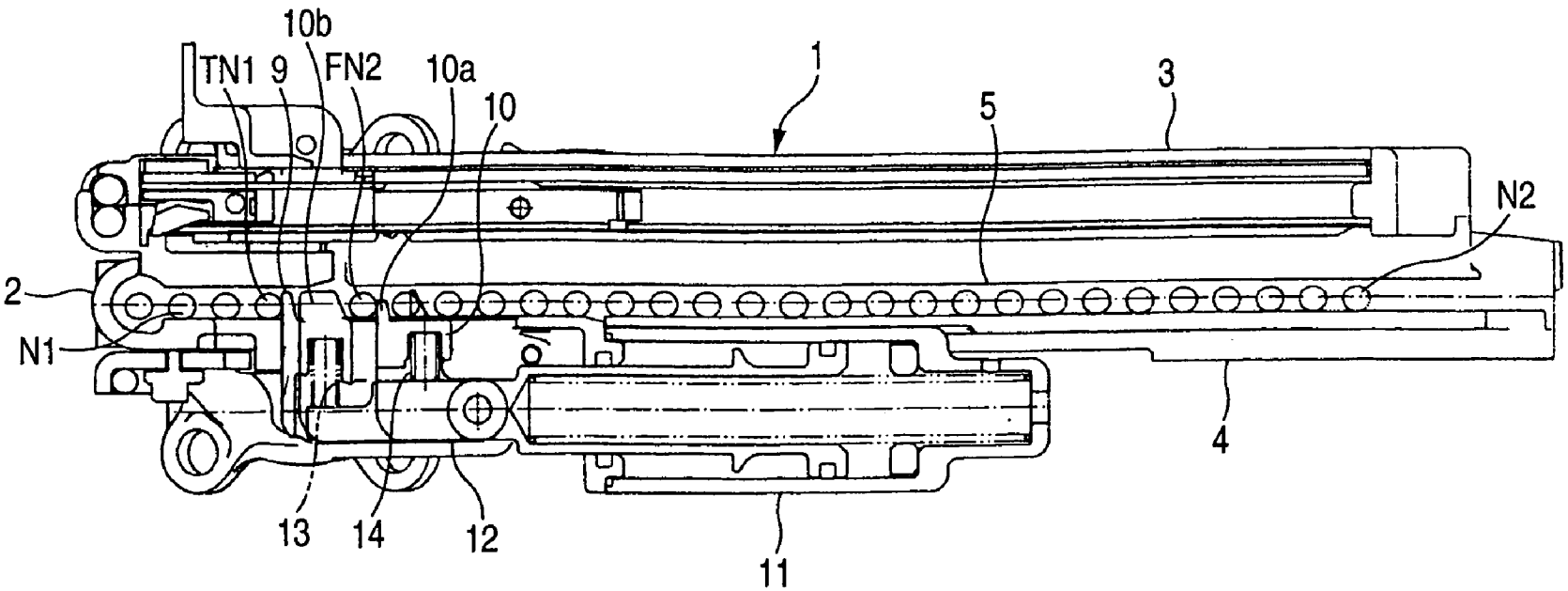
FIG. 6 is a view taken along the line B—B of FIG. 1, FIG. 7A through FIG. 7C show a left cover of a nail magazine according to a second embodiment.

When a main piston of the nailing machine is started and the piston rod 12 is moved rearward, the front feed claw 9 is moved rearward while being brought into contact with the side faces of the first row of connected nails N1 and enter between nails of the first row of connected nails N1 to engage therewith when a final end of a stroke is reached to stop and feeds the first row of connected nails N1 fowardly insuccessive forward movement. When consumption of the first row of connected nails N1 is progressed and the front feed claw 9 is moved rearward to catch a final nail TN1 of the first row, there is not a nail brought into contact with the contact portion 10*b* of the rear feed claw 10 and therefore, the contact portion 10*b* and the claw portion 10*a* move into the nail path, simultaneously therewith, the second row of connected nails N2 are pressed to a position of the first row and as shown by FIG. 6, the contact portion 10*b* enters between the final nail TN1 of the first row and a front nail FN2 of the second row and the claw portion enters a rear face of the front nail FN2 of the second row to engage therewith. Further, the first row of connected nails N1 are fed by the front feed claw 9, the second row of connected nails N2 fed by the claw portion 10*a* of the rear feed claw are pulled up at a front portion thereof along the inclined face 8 shown in FIG. 3 and FIG. 4 and set to an attitude of the first row of connected nails N1 shown in FIG. 3.

At a succeeding nail striking cycle, when the piston rod 12 is moved rearward from the state shown in FIG. 6, the contact portion 10*b* and the claw portion 10*a* of the rear feed claw 10 rides over the side faces of the second row of connected nails N2 and the contact portion 10*b* cannot enter between nails and therefore, the rear feed claw 10*a* returns to the state of being escaped from connected nails. Further, the front feed claw 9 is engaged with the front nail FN2 of the second row, the connected nails N2 of the second row press the first row of connected nails N1 to move forward integrally and nails are continuously supplied to the nose 2.

Second Embodiment

A nailing machine and a nose according to the embodiment are substantially similar to those of the first embodiment shown in FIG. 1 through FIG. 3 and a duplicated explanation thereof will be omitted.

FIG. 7 through FIG. 11 show a left cover 103. FIG. 7A is a view taken along a line A—A of FIG. 7C, FIG. 8B is a view taken along a line B—B of FIG. 9C and the same goes with FIG. 8 through FIG. 11. As shown by FIG. 7C, the left cover 103 is provided with a guide rail 107 reaching a rear end portion from a front end portion and the guide rail 107 is engaged with a connected nails charging mechanism 108.

FIG. 9 shows a state of moving a nail charger 109 of the connected nails charging mechanism 108 to a rear end position of the guide rail 107 and notation N1 designates connected nails disposed at the first row. The nail charger 109 is projected from the guide rail 107 in the direction of the right cover and is provided with a hook portion 9*a* extended from a front end portion in the rear direction. The nail charger 109 is formed such that a front portion of connected nails can be engaged with the hook portion 109*a* and is constituted such that by moving connected nails engaged with the hook portion 109*a* forward along with the nail charger 109, the connected nails are charged to be contiguous to the first row of connected nails which are already present at inside of the nail magazine. Numeral 110 designates a handle portion coupled to the nail charger 109, a claw 112 is attached to an elastic contact spring 111 attached to a face on an inner side of the handle portion 110 and the elastic contact spring 111 is brought into elastic contact with an outer side face of the guide rail 107.

Figures 9A, 9B, 9C:
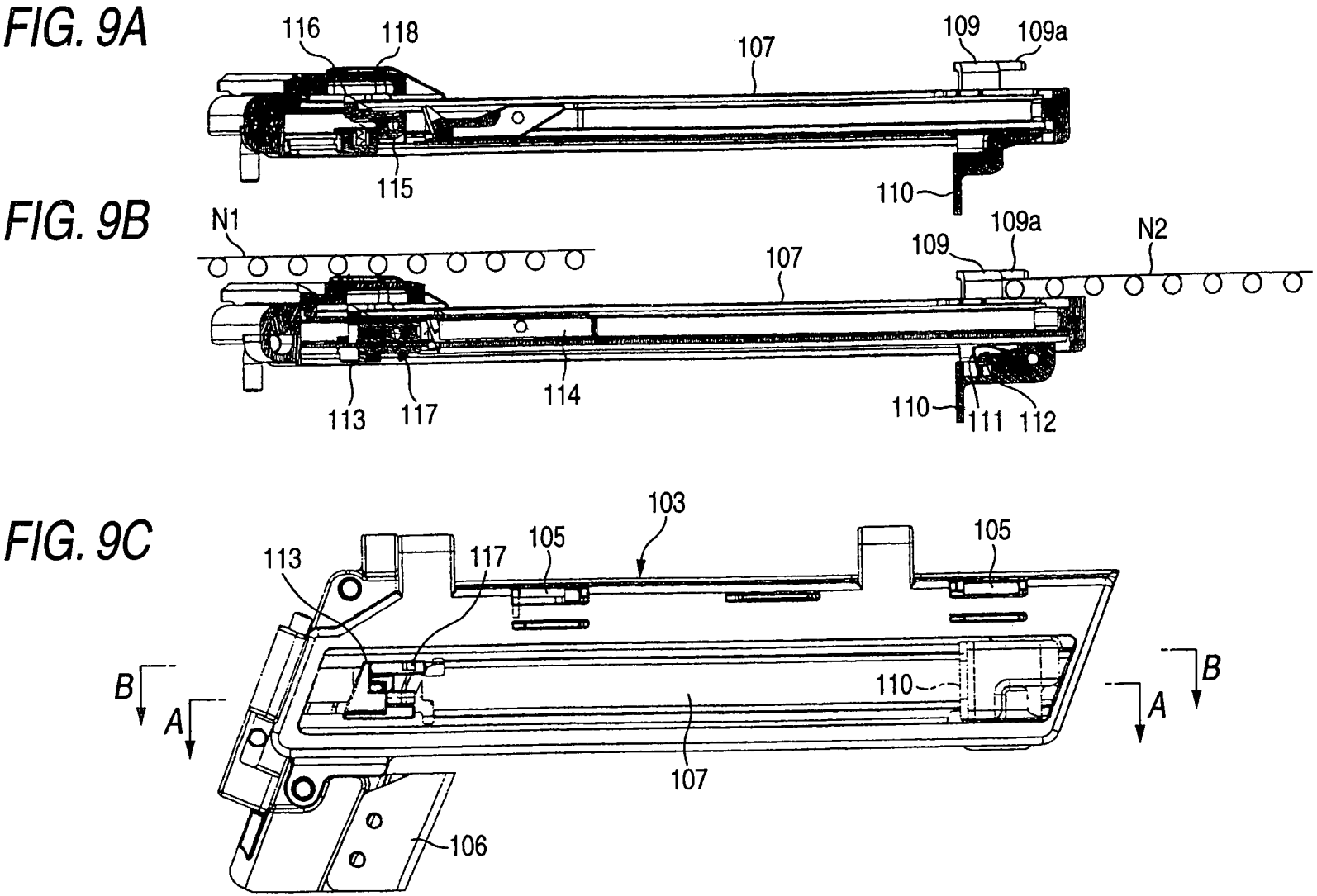
FIG. 9A through 9C show the left cover of the nail magazine according to the second embodiment.

The front portion of the guide rail 107 is attached with a charger holder 113 for holding the nail charger 109 at a front escaping position. The charger holder 103 is slidable in a constant range of the front portion of the guide rail 107 and is urged frontward by a compression coil spring (not illustrated) inserted into a spring chamber 114 at inside of the guide rail 107. As shown by FIG. 9A, the charger holder 113 is provided with a click stop lever 115, the front end of the click stop lever 115 is brought into elastic contact with an inner wall face on a right side (upper side in the drawing) of the guide rail 107 and at a moved-back position shown in the drawing, a claw 116 provided at the click stop lever 115 is engaged with a notch formed at the guide rail 107 from an inner side to be held at the moved-back position. Further, as shown by FIG. 9B, a claw 117 is formed at a left side face of the charger holder 113 and when the nail charger 109 is moved forward, the claw 112 of a swinging type of the nail charger 19 is engaged with the claw 117 of the charger holder 113.

Figures 7A, 7B, 7C:
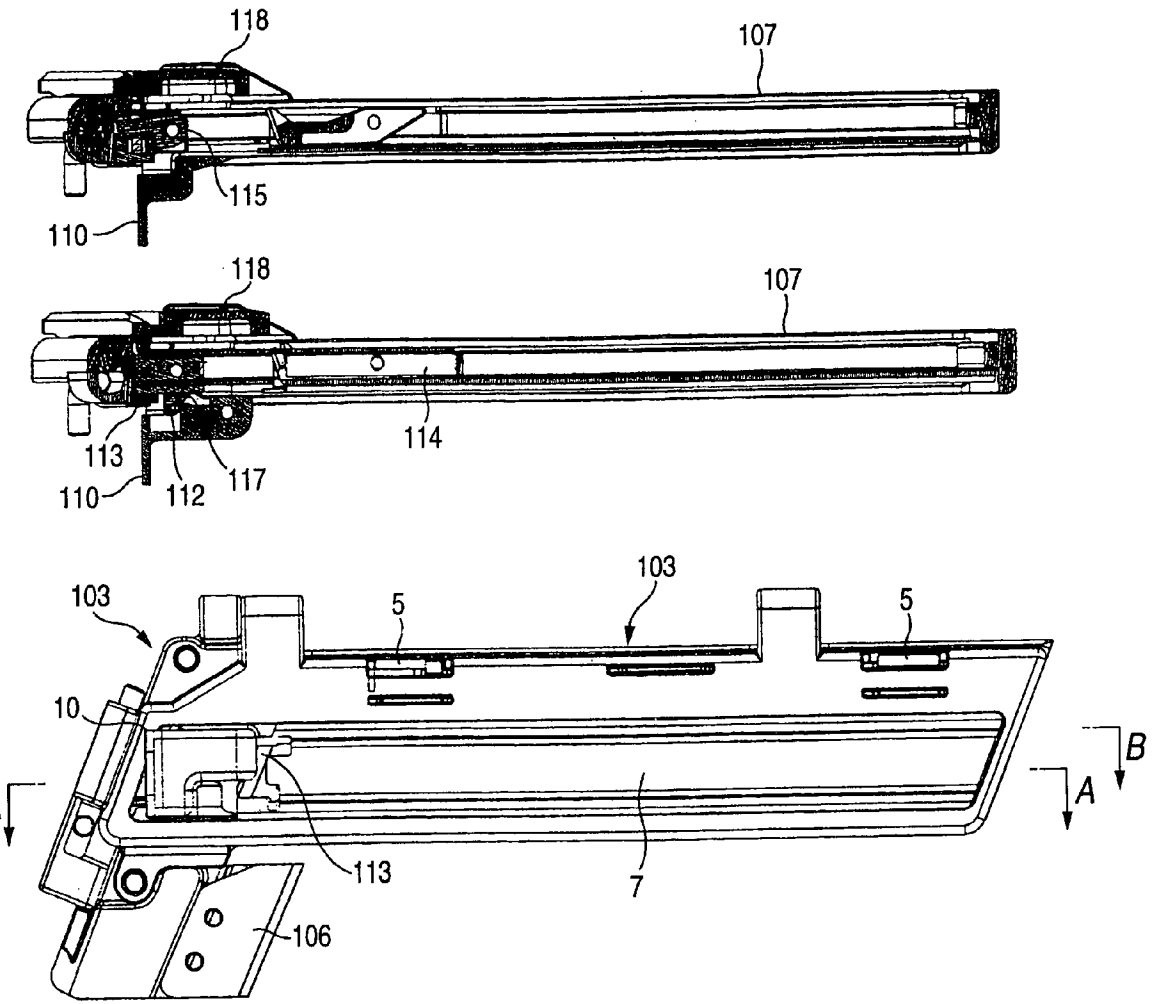
FIG. 7A is a view taken along a line A—A of FIG. 7C.
FIG. 7B is a view taken along a line B—B of FIG. 7C
FIG. 7C is a side view of the nail magazine.

Successively, operation of the connected nails charging mechanism 108 will be explained. FIG. 7A through FIG. 7C show an initial state, a nail guide portion 118 on a right side of a front portion of the left cover 103 is projected in a direction of a right cover, not illustrated, opposed thereto, forms a nail path communicating with the nose on the front side along with the right cover and guides the first row of connected nails to the nose.

The charger holder 113 is pressed by a compression coil spring (not illustrated) at inside of the spring chamber 114 to dispose at a front end of a moving stroke, as shown by FIG. 7B, the elastic contact spring 111 of the nail charger 119 enters a hole (not illustrated) formed at the front portion of the guide rail 107 and the claw 112 of the nail charger 109 is engaged with the claw 117 of the charger holder 113, the nail charger 109 is fixed to the front end position and the hook portion 9*a* is disposed frontward from the nail guide portion 118 to escape to a position at which the hook portion 9*a* does not hinder nail feeding.

Figure 8A:
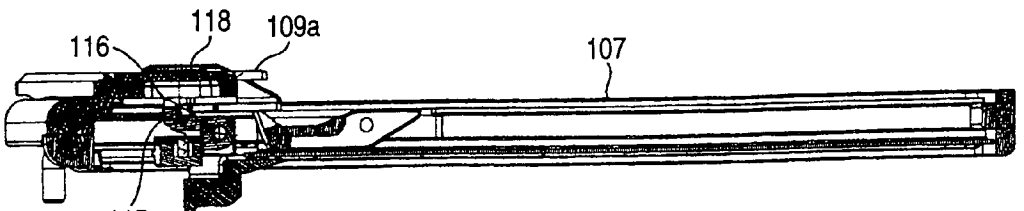
FIG. 8A through 8C show the left cover of the nail magazine according to the second embodiment.
Figure 8B:
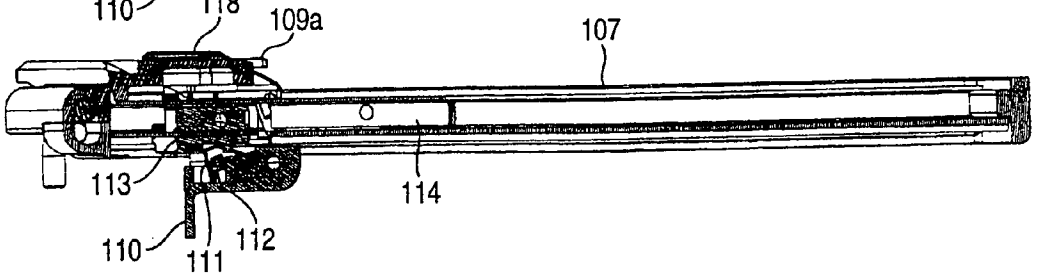
Figure 8C:
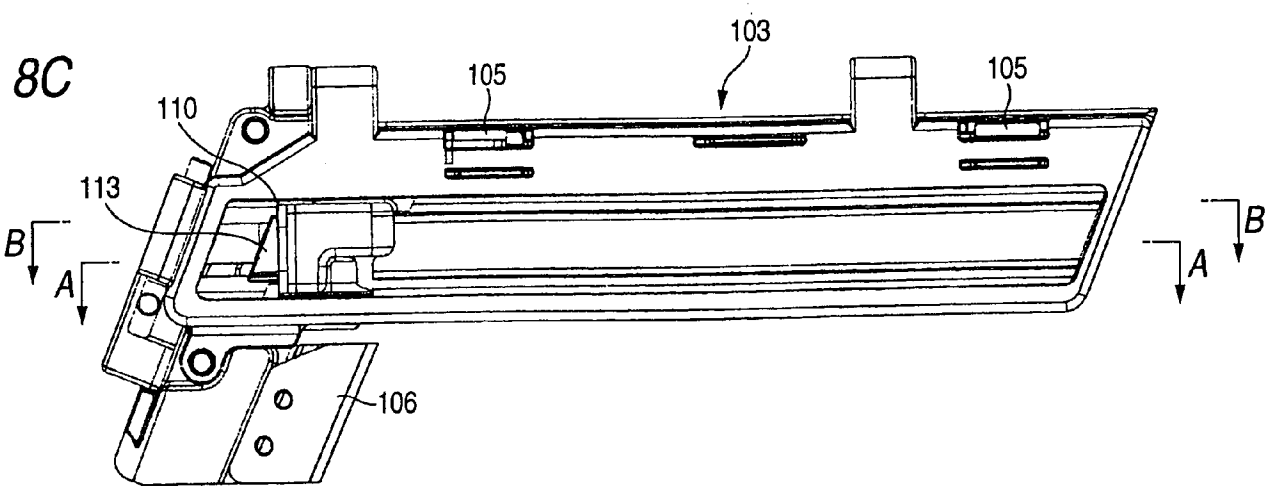

FIGS. 8A through 8C show a state of pulling down the handle portion 110 rearward by the finger, when the nail charger 109 and the charge holder 113 are moved rearward integrally by a certain distance (about 20 mm according to the embodiment), the clip stop lever 115 of the charge holder 113 is engaged with the notch of the guide rail 107 to be held at the moved-back position, further, when the handle portion 110 is pulled, the elastic contact spring 111 of the nail charger 119 comes out from the hole of the guide rail 107 and is mounted on the-outer wall face of the guide rail 107. Thereby, the claw 112 of the nail charger 109 is moved to the outer side and detached from the claw 117 of the charger 113, the nail charger 109 is separated from the charger holder 113 and only the nail charger 109 is moved back.

Figures 10A, 10B, 10C:
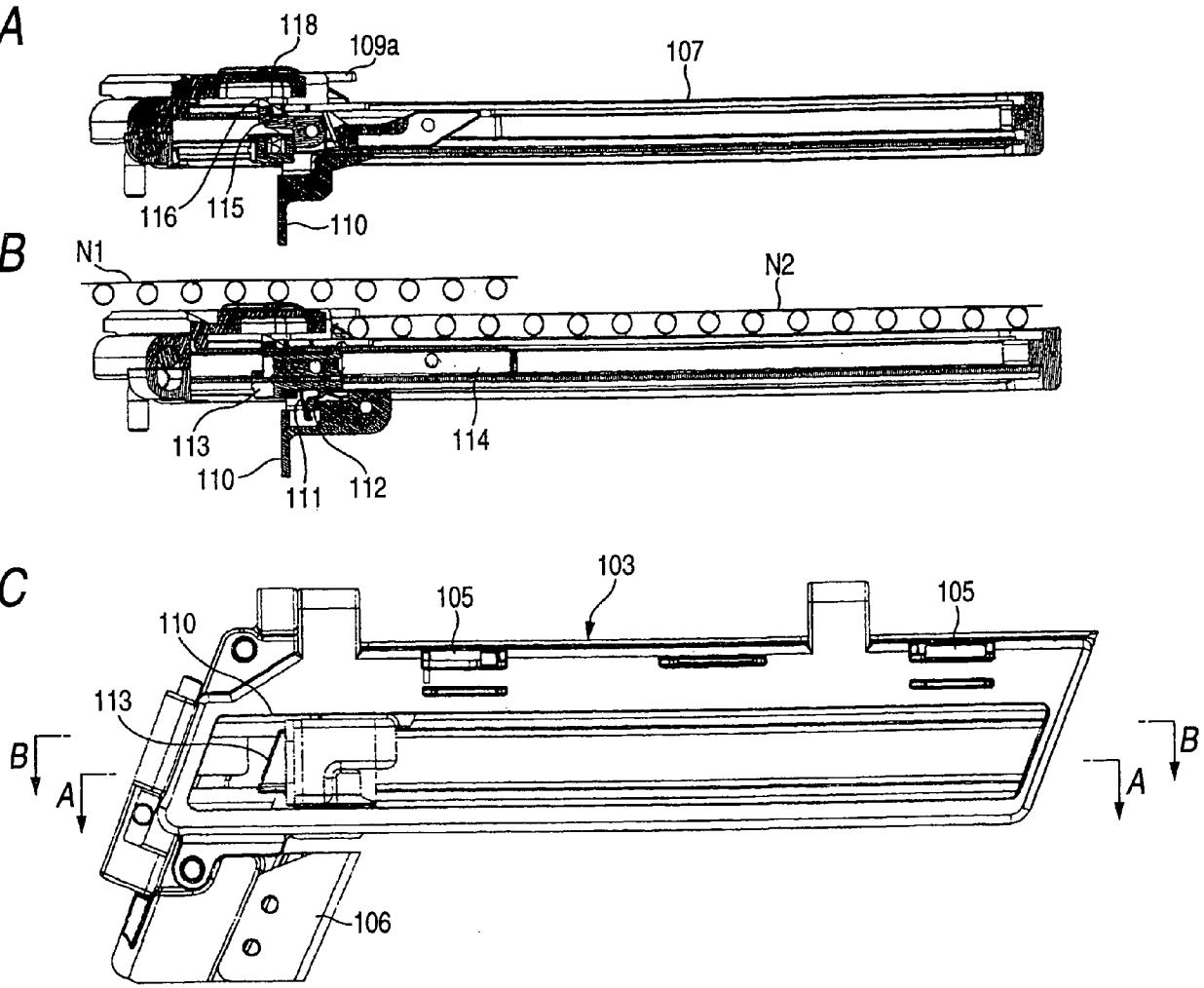
FIG. 10A through FIG. 10C show the left cover of the nail magazine according to the second embodiment.
Figure 11A:
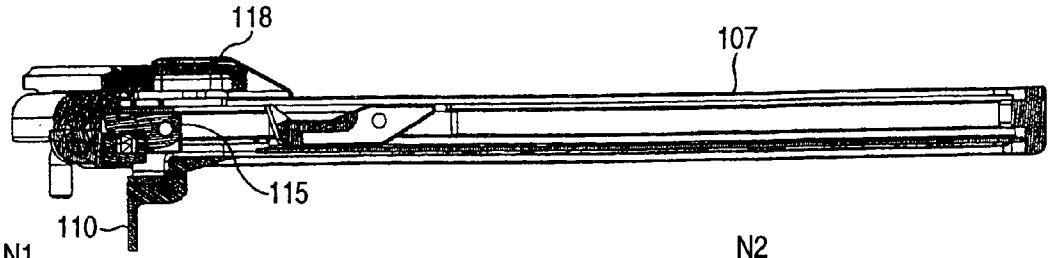
FIG. 11A through FIG. 11C show the left cover of the nail magazine according to the second embodiment.
Figure 11B:
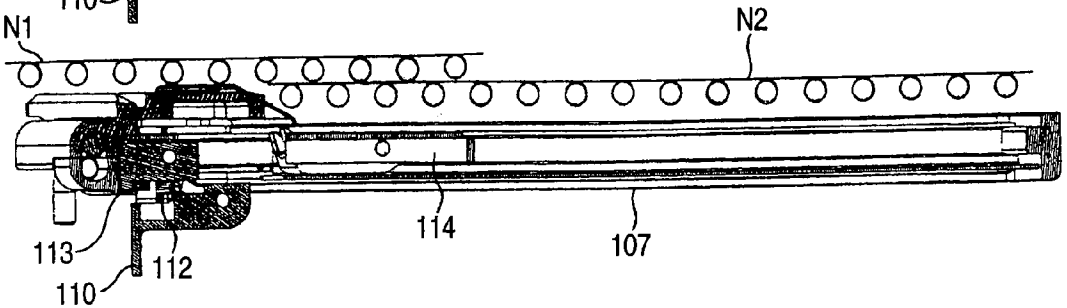
Figure 11C:
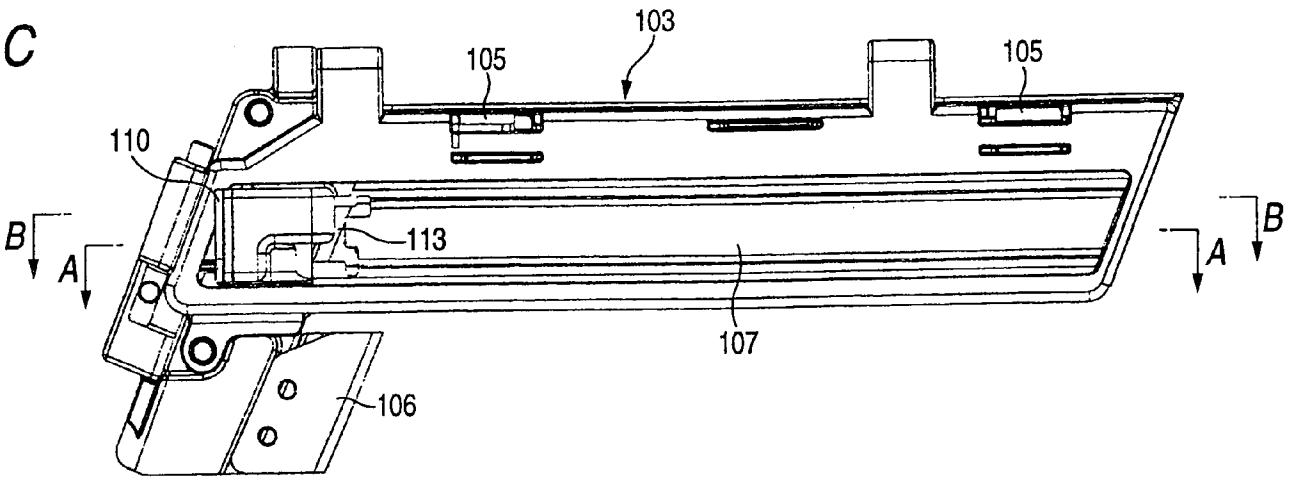
Figure 12:
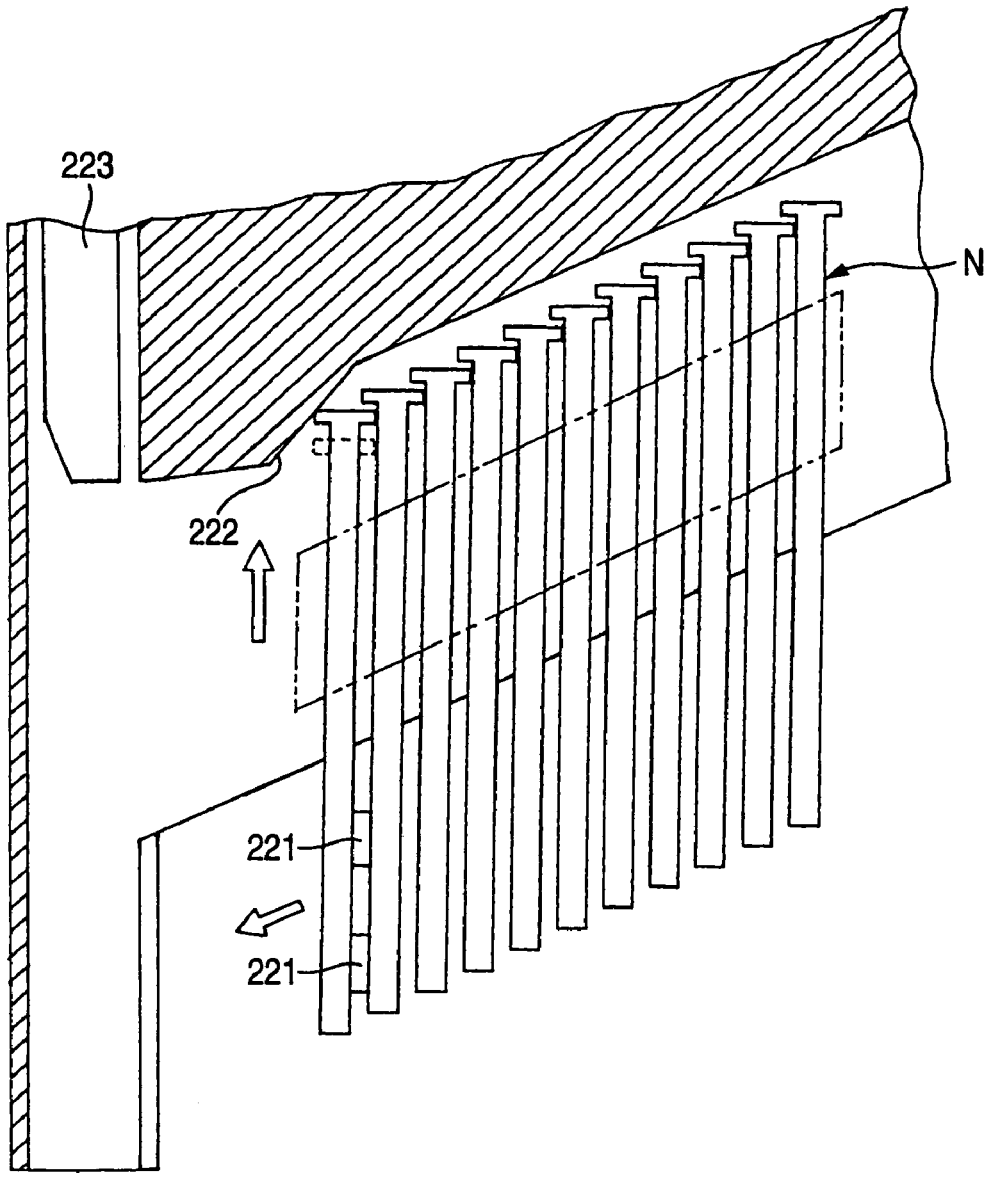
FIG. 12 is an outline view of a nail striking magazine of a related art.

Further, as shown by FIGS. 9A through 9C, when the nail charger 109 is moved down to the rear end position, the front end portion of the connected nails N2 is engaged with the hook portion 109*a* of the nail charger 109 and the connected nails N2 are pressed forward, the connected nails N2 are inserted along the right side face of the left cover 103 while pressing down the pressure plate (not illustrated) by being guided by the nail charger 109. Further, as shown by FIG. 10B, the claw 112 of the nail charger 109 rides over the claw 117 of the charger holder 113 and both of the claws 112 and 113 are engaged with each other and the nail charger 109 is coupled to the charger holder 113. Simultaneously therewith, as shown by FIG. 10A, the nail charger 109 presses down the claw 116 of the click stop lever 115 of the charger holder 113 to press down the click stop lever 115 to the inner side, the click stop lever 115 is detached from the notch of the guide rail 107 and a stationary state is released. Thereby, as shown by FIG. 11, the compression coil spring at inside of the spring chamber 114 moves in the charger holder 113 and the nail charger 109 integrally to the front end portion, the hook portion 109*a* of the nail charger 109 is detached from the second row of connected nails N2, the hook portion 109*a* is moved forward from the nail guide portion 118 to escape to a position at which the hook portion 109*a* does not hinder nail feeding and the second row of connected nails N2 are pushed by the pressure plate 5 at the upper portion of the left cover 103 shown in FIG. 3 and FIG. 11C to be brought into press contact with the side faces of the first row of connected nails N1 to thereby finish charging.

Further, although as shown by FIG. 3, the nail magazine 1 is constituted such that the nail heads of the second row of connected nails N2 are disposed below the nail heads of the first row of connected nails N1, the front face of the hook portion 109*a* of the nail charger 109 may be formed by an inclined face and in charging nails, the hook portion 109*a* may be constituted to press up the nail heads of the first row of connected nails N1 to the upper side, thereby, the nail heads of the second row of connected nails N2 can firmly be inserted to lower sides of the nail heads of the first column of connected nails N1. Further, in order to prevent connected nails from unpreparedly detaching from the hook portion 109*a* of the nail charger 109, the nail charger 109 may be provided with a check claw engaged with connected nails.

Further, the invention is not limited to Embodiments 1 and 2 mentioned above, but the invention can variously be modified and changed within the technical range of the invention and the invention naturally covers modified and changed constitutions.

The application is based on Japanese Patent Application 2001-296053 filed on Sep. 27, 2001, Japanese Patent Application 2001-296256 filed on Sep. 27, 2001 and Japanese Patent Application 2001-297827 filed on Sep. 27, 2001 and contents thereof are incorporated here by reference.

INDUSTRIAL APPLICABILITY

As has been explained above, the nail magazine of the invention is constituted such that the two front and rear feed claws are provided, when the front feed claw feeds the first row of connected nails and the first row of connected nails pass the contact portion formed at the front portion of the second feed claw, the second feed claw is engaged with the successive row of connected nails and therefore, the successive row of connected nails starts feeding after feeding the first row of connected nails, two sheets of the connected nails are not overlappingly fed to the nail path, nail clogging can be prevented from being brought about to achieve an effect of stabilizing nail feeding of the series charging type nail magazine.

Further, the nail magazine of the invention is constituted such that the front portion of the guide groove for guiding the first row of connected nails is provided with the support face for supporting the connected nails at the high position, the fed connected nails rise to the high position support face by passing the rising inclined face and supported at the position higher than the second row of connected nails and therefore, nail feeding is smoother than that of the nail magazine of the background art in which in using connected nails of a front moving down type, the first row of connected nails are moved down to the low position along the moving down guide groove.

Further, the nail magazine of the invention is constituted such that the hook type member slidable frontward and rearward along the inner wall face opposed to the nail guide face in the nail magazine is provided, the front portion of the connected nails to be charged is engaged with the hook type member and the hook type member and the connected nails are integrally slid frontward to thereby charge the connected nails by being guided by the hook type member and therefore, even when the connected nails are present at inside of the nail magazine, the charged connected nails are charged to the predetermined position without being collided with the tail of the connected nails at inside of the nail magazine and the connected nails can simply and easily be charged.

The invention claimed is:

1. A nail magazine of a nailing machine comprising:

a nail containing chamber for overlappingly containing plural sheets of sheet type connected nails in parallel;

a nail feeding air cylinder for feeding a first sheet of the connected nails to a nose by a feed claw; and a pressing member for pressing the sheets of connected nails in the nail magazine in a direction of the first sheet, wherein the nail containing chamber comprises a guide groove for supporting heads of nails of the first sheet of connected nails, and the guide groove includes an inclined face rising to a front side and a high position support face, wherein the first sheet of connected nails fed by the feed claw are pulled up to a position higher than positions of a second sheet of connected nails and supported at a different stage.

* * * * *